US005355594A

United States Patent [19]

Hwang

[11] Patent Number: 5,355,594

[45] Date of Patent: Oct. 18, 1994

[54] EVAPORATIVE SLUDGE STABILIZATION

[76] Inventor: Daekyoo Hwang, 1671 Bow Tree Dr., West Chester, Pa. 19380

[21] Appl. No.: 994,614

[22] Filed: Dec. 21, 1992

[51] Int. Cl.[5] ..... F26B 3/00

[52] U.S. Cl. ..... 34/356; 34/95

[58] Field of Search ..... 34/9, 12, 60, 95, 356

[56] References Cited

U.S. PATENT DOCUMENTS

| | | |
|---|---|---|
| 3,732,697 | 5/1973 | Dickson . |
| 3,920,795 | 11/1975 | Selmeczi et al. . |
| 4,016,073 | 4/1977 | Jordan . |
| 4,092,247 | 5/1978 | Madsen . |
| 4,254,565 | 3/1981 | Jenkins et al. . |
| 4,290,890 | 9/1981 | Bauer . |
| 4,306,978 | 12/1981 | Wurtz . |
| 4,402,756 | 9/1983 | Prine . |
| 4,402,834 | 9/1983 | Bastgen et al. . |
| 4,464,257 | 8/1984 | Lynch et al. . |
| 4,500,428 | 2/1985 | Lynch et al. . |
| 4,539,121 | 9/1985 | Kapland et al. . |
| 4,552,666 | 11/1985 | Müller . |
| 4,587,022 | 5/1986 | Shimizu et al. . |
| 4,618,735 | 10/1986 | Bridle et al. . |
| 4,657,682 | 4/1987 | Uyama et al. . |
| 5,037,561 | 8/1991 | Copeland . |
| 5,051,194 | 9/1991 | Bähr . |
| 5,069,801 | 12/1991 | Girovich . |

OTHER PUBLICATIONS

Abstract of El-Ariny A. S., "Utilization of Solar Energy for Sludge Drying Beds," Journal of Solar Energy Engineering, vol. 106, No. 3 (Aug. 1984).

Linsley, Ray, Max Kohler and Joseph Paulhus, "Hydrology for Engineers, " pp. 88, 173, McGraw-Hill Book Company (1975).

U.S.E.P.A., "Process Design Manual for Sludge Treatment and Disposal," EPA 615/1-74-006, Technology Transfer (Oct. 1974).

U.S.E.P.A., "Design Manual-Dewatering of Municipal Wastewater Sludges," EPA 615/1-87-014, (Sep. 1987).

Viessman, Jr., Warren, John Knapp, Gary Lewis and Terrence Harbaugh, "Introduction to Hydrology," p. 52, Harper & Row, Publishers (1977).

Abstract of "Solar Drying of Sludge: Greenhouse Versus Open Bed: The protection greenhouses afford against rain may not be necessary," NTIS Tech Note, Department of Energy, Washington, D.C. (Apr. 1984).

Abstract of Cruz Perez, R., "Sludge Treatment and Disposal in a Tropical Environment," Third Caribbean Islands Water Resources Congress. Proceedings of a Symposium held in St. Thomas, U.S. Virgin Islands, Jul. 22-25, 1986.

Abstract of Novak, John T., "Characterization and Dewaterability of Water Treatment Plant Residues," (Completion rept.), Missouri Water Resources Research Center, Columbia, Office of Water Research and Technology, Washington, D.C., Report No. W75-04039 (Oct., 1974).

Abstract of Hedstrom, J. C. and J. S. Dreicer, "Solar Drying of Sewage Sludge," Dept. of Energy, Washington, D.C., Report No.:LA-9317-MS (May 1982).

Abstract of Marklund, S. "Dewatering of sludge by natural methods," Water Science and Technolgy, v 22, n 3-4 1990, pp. 239-246 (1990).

*Primary Examiner*—Henry A. Bennet

*Attorney, Agent, or Firm*—Ratner & Prestia

[57] ABSTRACT

A method of maximizing net water loss from various sludges in the outdoor environment to stabilize or to reduce the volume and weight of sludges. Specifically, this method comprises drying a layer of wet sludge by surface evaporation, mixing a sufficient amount of additional wet sludge to the previously-dried sludge layer to form a sludge mixture having a water content at which surface evaporation is maximized, and drying the sludge mixture by surface evaporation or by periodical tilling or both. Additionally, the sludge surface is sealed by light compaction in the event of imminent precipitation to minimize rainwater retention and infiltration. In addition to stabilization, this method may be used as an effective pretreatment step towards other sludge treatment processes to drastically reduce the sludge treatment cost, based on the reduction of the sludge volume, sludge weight, and sludge water content.

26 Claims, 6 Drawing Sheets

EVAPORATIVE SLUDGE STABILIZATION

FIELD OF THE INVENTION

This invention pertains to a method for physically stabilizing wet sludge. In particular, this invention pertains to a method for physically stabilizing wet sludge by maximizing the evaporation rate of water from sludge and by minimizing rainwater retention in sludge.

BACKGROUND OF THE INVENTION

Industries generate various forms of wastes as part of production, manufacturing and pollution control operations. Among various wastes, sludges are one of the most common forms of wastes. Examples of industry groups and associated sludge sources include the following:

Chemical—wastes and wastewater sludges
Petrochemical—filter clay, API separator bottom sludge, wastewater sludge
Aluminum—red mud, brown mud, gypsum
Power plants—flue gas desulfurization sludge, flyash, gypsum, cooling water mud
Metal Finishing/Plating—grit sedimentation, acid neutralization and dissolved metal precipitation sludges
Pulp/paper—lime mud, fiber sludge, waste clay, wastewater sludge
Phosphate mining—clay slime
Mining, metals, and minerals—mine and mill tailings
Drinking water supply—alum and ferric coagulation sludges
Food processing—food waste and wastewater sludges
Textile, dye, pigment—dye wastes and wastewater sludges
Sewer treatment plants—wastewater sludge
Pharmaceutical—waste and wastewater sludges
Plastics, rubber—waste and wastewater sludges
Iron, steel, coke—primary, scrubber blowdown, wastewater sludges Sludge wastes are very difficult to manage. They are too thick to discharge into natural water bodies, too soft to be built upon or to be placed in a landfill, too high in various chemicals to neglect and too large in quantity to manage by simple disposal. Sludge wastes are considered "unstable" because they tend to flow if not contained, are too soft to support any significant load, and deform excessively under loads. Generally, it is the high water content of sludge waste which makes it unstable. Most sludge wastes are not suitable for productive uses.

Some of the most common sludge management practices include 1) disposal in ponds, 2) mechanical dewatering, 3) solidification/stabilization, and 4) air drying.

Pond disposal is only an interim solution. When a disposal pond is full or further disposal is not allowed due to certain regulatory requirements, the sludge pond has to be closed, usually with a final cover installed over the pond to securely contain the waste.

Typical sludges in sludge disposal ponds contain 10 to 40% of solids by weight. A low solids content is characteristic of sludges containing biologic or amorphous salt/minerals with a low specific gravity. A high solid content is characteristic of sludges with plate-like or block-like particles of minerals and grit with a high specific gravity. A typical sludge having a solids content of 30% by weight has a solids content of only about 15% by volume because the solid part of the sludge has a higher specific gravity than water. Therefore, the majority (85%) of the sludge volume is water. This signifies the value of water removal from the sludge.

If a substantial portion, but not necessarily 100%, of this water is somehow removed, the sludge water content will be much lower, the sludge more stable, and the sludge volume much less. Water can be removed by various forms of mechanical dewatering such as filter press, belt press, centrifuge, vacuum filter, and others. Mechanical dewatering is most commonly used as the last step in a sludge generation process prior to landfill disposal. Less frequently, this process is also used as a stabilization step for closure of sludge ponds. Dewatered sludges are often stabilized further by a solidification/stabilization process. Unfortunately, mechanical dewatering is very expensive, costing typically between $25 and $70 per cubic yard of raw sludge, depending on the sludge characteristics, dewatering method and conditioning needs. At this cost, the advantages of lower water content and volume disappear. To be practical, the method of water removal and volume reduction should be economical.

To install a final cover and to minimize leachate migration into the environment, a sludge requires "stabilization," either physical stabilization (solidification) or chemical stabilization (fixation). Physical stabilization improves the physical properties of the sludge to support the final cover and construction equipment. Chemical stabilization "fixates" certain chemicals in the sludge to reduce the leachability of chemical constituents. Often, chemical stabilization also achieves physical stabilization and vice versa. This is why sludge or soil stabilization is often referred to as a solidification/stabilization (S/S) process, implying both physical stabilization and fixation.

The most common method of sludge stabilization is the solidification/stabilization (S/S) process in which various dry reagents are mixed with the sludge. Examples of reagents include cement, flyash, lime, lime kiln dust, cement kiln dust, slag, silicate, and other proprietary additives.

Three major effects of reagent stabilization are: (1) removal of excess water in the sludge by hydration; (2) hardening of the sludge/reagent mixture; and (3) fixation of inorganic chemicals, primarily metals, by various chemical reactions. With removal of water and hardening of the material, the stabilized wastes can support the final cover and cover installation equipment. With removal of water and fixation of certain chemical constituents, post-closure migration of chemicals through leachate is minimized.

This process has been widely applied to various sludge wastes for the closure of existing disposal ponds or for the treatment of sludges at the end of a waste generating process prior to landfill disposal. However, the S/S process increases the total volume and weight of the waste because a significant amount of reagent is added to treat the entire mass including water. An increase in waste volume or weight is undesirable in waste management. In addition, S/S is an expensive treatment method, costing from a low of $20 to a high of $100 or more per cubic yard depending on the waste properties, site conditions, and S/S performance requirements.

Air drying is another common method of sludge dewatering. The following three types of sludge drying beds have often been used to dewater municipal wastewater sludges: sand drying beds, drying lagoons and paved drying beds. Dilute liquid sludges with about 5% solids content are placed in these facilities and allowed to drain and to dry to a solids content between 25 and 40%. Dried sludge is removed by various equipment such as a front end loader or manually for small quantities. The removed sludge is hauled away for subsequent disposal such as landfilling or land application.

A description of sand drying beds is found in USEPA 1987, Section 6.2. Typical construction of a sand drying bed consists of a large area of a sand bed underlain by a layer of gravel and enclosed by concrete sidewalls. Sludge is applied on the sand bed, with a typical application depth of 8 to 18 inches. Water is drained by gravity into the sand bed and then into the gravel layer. Drain pipes embedded in the gravel layer remove water from the gravel layer. In addition to gravity drain, additional water is removed by evaporation. Since the majority of water is removed by gravity drain, the local climate is not critical for sand bed performance. One sludge drying cycle is four to twelve weeks, depending on climate and sludge conditioning.

Some sand beds are constructed with a greenhouse roof to avoid rewetting by rain (El-Ariny A.S., "Utilization of Solar Energy for Sludge Drying Beds," Journal of Solar Energy Engineering, Vol. 106, No. 3, Aug. 1984). Since some sand is also removed during sludge removal, sand should be replenished periodically. Sand bed performance may be enhanced by freezing the sludge or by applying a vacuum to the drain pipe.

A description of drying lagoons is found in USEPA, 1987, Section 6.2 and USEPA, 1974, Section 7.5. A drying lagoon is very similar to a sand bed except that the drainage is provided by the natural sand deposit at the bottom of the lagoon and the sidewall is an earthen dike. Sludge is applied to the lagoon in 24 to 48 inch depths and allowed to drain by gravity and to dry by evaporation. Lagoon drying is relatively inefficient, requiring several months to one year per cycle of drying, and therefore requires large land areas. Dewatered sludge is removed by mechanical equipment. Drained water enters the ground water body and degrades the ground water quality. Because of its impact on the ground water quality, this method is no longer a viable method of sludge dewatering.

Two primary problems exist with sand beds and drying lagoons: the drying rates are very slow after a surface crust is formed and the drying areas are not adequate to support sludge removal equipment. Drying beds constructed with a concrete or asphalt pavement solve these two problems. A description of paved drying beds is found in USEPA, 1987, Section 6.7.

The drying rate in a paved drying bed may be improved by breaking the surface crust and aerating the wet sludge with mechanical equipment. Various equipment can be used on top of the paved beds to aerate the sludge and to remove the dried sludge. However, this method sacrifices good bottom drainage, typical of sand beds and drying lagoons, due to the relatively impermeable underlying bed material such as asphalt and concrete.

The process of drying sludge by using a paved drying bed involves applying the sludge to the paved bed, decanting water after the settling of solids, and allowing the sludge to dry. After the surface crust is formed, the sludge is turned and aerated, to accelerate the drying process. The paved drying bed works best in warm, arid and semi-arid climates since water loss depends on evaporation. In arid climates, a 12-inch layer of sludge can attain a solids content of 40 to 50% in 30 to 40 days. In the same climate, it might require 100 to 250 days for a 3 feet thick sludge layer to reach 50% solids. The annual evaporation rate from a paved drying bed is given by (USEPA, 1987, Eq. 6-11):

$$R_e = 62.4(K_e)(E_p) \quad (1)$$

where:

$R_e$ = Evaporation potential for mixed and aerated sludge on a paved bed (lb/year.ft$^2$), $K_e$ = A reduction factor, a typical value is 0.6, and Ep = Pan evaporation rate (ft/year).

This equation may be rewritten as follows using Ke = 0.6 and evaporation in inches per year:

$$Re = 0.6\ Ep \quad (2)$$

where:

Re = Evaporation potential for mixed and aerated sludge on a pave bed (in/year)

Ep = Pan evaporation rate (in/year).

The performance of the paved drying bed may be severely limited by rain falling on the loosened sludge. Because of large voids in the loosened sludge, rainfall will be retained in the sludge except during extremely intense rainfall, after which excess water may be decanted. The proportion of rainfall requiring evaporation would be 70 to 100% of the annual rainfall, which greatly increases the total time to achieve the desired solids content. Therefore, the paved drying bed requires a very large area to treat a large volume of sludges. For example, the City of Forth Worth, Tex. operates a paved bed area of 193 acres for sludge drying, as indicated in USEPA, 1987, Section 6.7.

As an indication of the paved bed performance, Table 1 presents estimated annual net water loss for four regions based on Equation 2, published evaporation/precipitation data (Linsley, et al., 1975, FIG. 3-14 for precipitation and FIG. 5-7 for evaporation), and an assumed rainfall retention rate of 80%. Table 1 indicates that paved bed drying is effective only in arid (Phoenix, Ariz.) and semi-arid (Fort Worth, Tex.) regions. Although the paved bed is not effective in humid climates, it may show limited success during periods of little or no precipitation.

TABLE 1

Net Water Loss by Paved Drying Beds (in/year)

| | Savannah Georgia | Madison Wisconsin | Fort Worth Texas | Phoenix Arizona |
|---|---|---|---|---|
| (1) Lake Evap | 44 | 30 | 60 | 72 |
| (2) Pan Evap | 62 | 42 | 84 | 101 |
| (3) PBD Evap | 37 | 25 | 50 | 60 |
| (4) Precipitation | 48 | 32 | 28 | 8 |
| (5) Rewetting | 38 | 26 | 22 | 6 |
| (6) Net Water Loss | 1 | −1 | 28 | 54 |

Notes:
(1) Lake Evaporation from Linsley, et al., FIG. 5-7
(2) Pan Evaporation, Ep = Lake Evaporation × 1.4
(3) PDB Evaporation from Equation Re = 0.6 Ep
(4) Precipitation from Linsley, et al., FIG. 3-14
(5) Rewetting depth = 0.8 × Precipitation
(6) Net water loss = PDB Evaporation − Rewetting depth It should be noted that the paved drying bed, like sand bed drying, is a batch operation facility and the dried sludge must be removed prior to the next drying batch is placed. Also, because of the large land area required, the paved bed procedure is primarily applicable to towns or cities with large land areas available at low cost.

The prior art methods presented above are either expensive or ineffective for large volume sludges being generated or accumulated over a long period of time. Thus, sludge-generating industries have yet to find an economical and environmentally safe method for sludge management.

SUMMARY OF THE INVENTION

In accordance with this invention, sludge is stabilized by surface evaporation at an optimum sludge consistency achieved by mixing of wet and dried sludges. First, a layer of wet sludge is dried by surface evaporation. Then, a sufficient amount of additional wet sludge is added to and mixed with the previously-dried sludge to form a sludge mixture having a specific consistency. This consistency should be sufficiently self-supporting to attain significantly increased evaporation surface area and void spaces within the sludge mass, while maintaining a sufficiently high surface water content, wherein the combined effect of the increased evaporation surface area and the high surface water content is to maximize surface evaporation. To achieve such a consistency, the water content of the sludge mixture should be within an operable range namely between about 20% and 60% of water by weight. Preferably, immediately after mixing, the water content of the sludge mixture is near the upper end of the operable range, namely about 50-60% water by weight. This permits the formation of an irregular surface and voids that increase contact area with surrounding air and increase evaporation. Further drying of the sludge mixture is effected by continued surface evaporation. Dry soil may be used in place of the first dried sludge to initiate the process.

According to an alternative embodiment of the invention, the mixing and drying steps described above are successively repeated. For example, a sludge layer is allowed to dry for a period of time by surface evaporation. Then, additional wet sludge is mixed with the dried sludge, and drying of the new sludge mixture is then effected by continued surface evaporation and/or subsequent mixing with additional wet sludge.

According to another alternative embodiment of the invention, incipient precipitation is restricted from infiltrating the sludge by selectively sealing the sludge surface. The step of restricting precipitation may include compacting the sludge by rolling a light and wide compaction device, such as tires mounted on a common axle, over the sludge surface prior to rainfall events. The axle should carry a bearing weight sufficient to effect compaction of the mixture and resultant sealing. Additionally, a mild slope and tracks may be formed on the sludge surface to create channels from higher elevation to lower elevation to promote water runoff. Generally, the step of restricting precipitation occurs when the drying sludge layer has a water content near the lower end of the operable range, such as about 20% to 30% water by weight, which produces a sludge consistency ideal for sealing.

According to another alternative embodiment of the invention, a drying sludge layer is periodically tilled as required to enhance evaporation. The sludge should be tilled whenever the sludge surface dries sufficiently, for example to the lower end of the operable range, to permit sufficient surface evaporation. The substantially dried sludge may then be disposed of in place, transported for off-site disposal, or treated by another sludge treatment method, such as S/S, incineration, or biodegradation. For in-place disposal, a final cover may be placed over the substantially dried sludge.

According to still another embodiment of the invention, an exposed layer of wet sludge is dried by surface evaporation to form a dried exposed layer. Then, the dried exposed layer is periodically tilled to form an altered exposed layer having a consistency at which surface evaporation is maximized. Also, incipient precipitation is restricted from infiltrating the sludge by selectively sealing the sludge as discussed above.

According to still another embodiment of the invention, in the case of an organic wet sludge, an organic binder is added to the wet sludge prior to drying to prevent emissions of odors of volatile organic compounds.

DETAILED DESCRIPTION OF THE INVENTION

Definition of Terms

Figure 1:
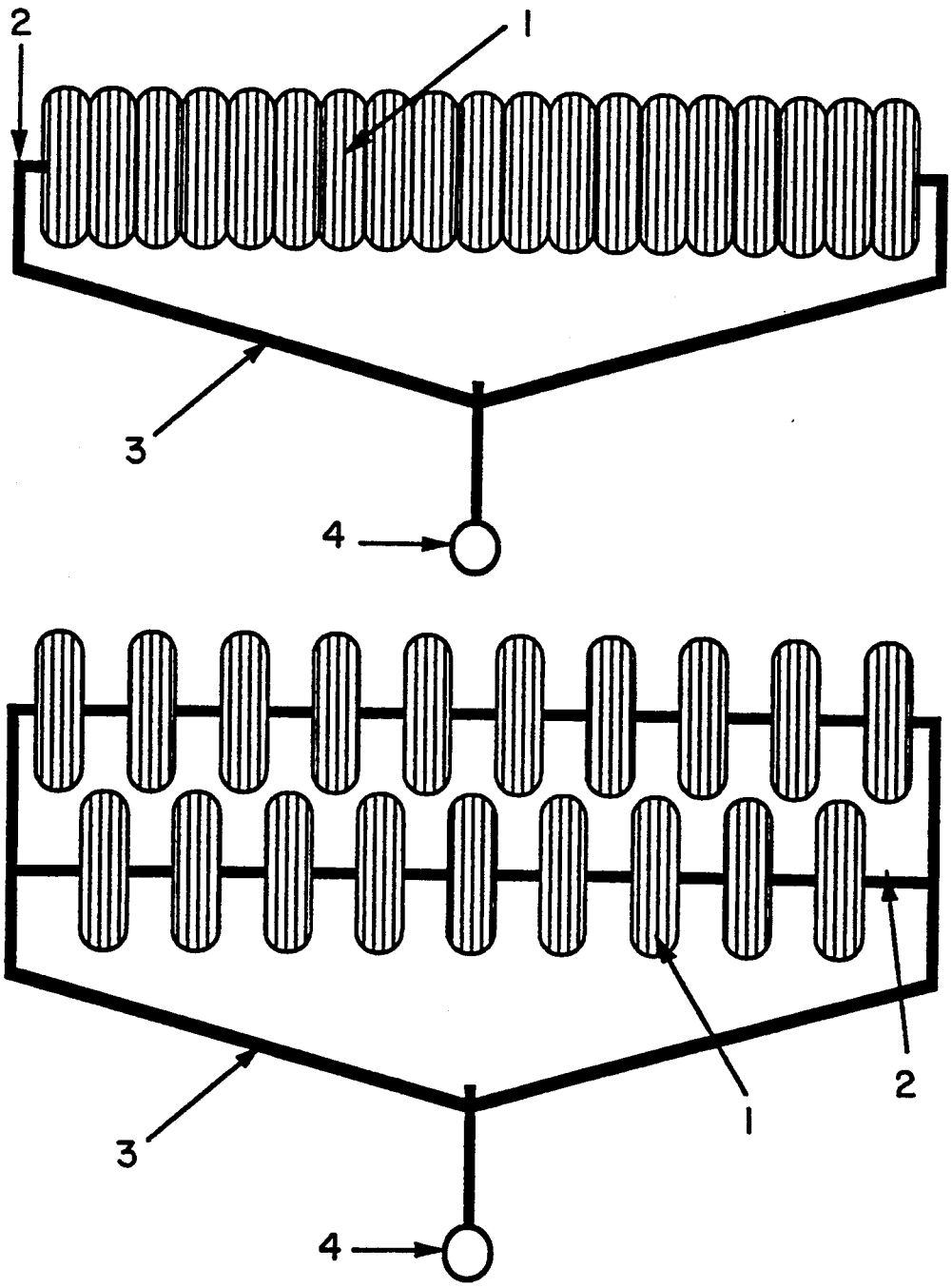
FIG. 1 is a plan view of a sludge sealing tire arrangement in accordance with the present invention.

To clarify possibly confusing terminologies, this document will use the following terms and definitions.

Sludge—A general class of wastes, process residues, and contaminated soils that are unstable due to the high water content in the material. Sludges may be classified by the particle size and type of solids, such as clayey sludge, silty sludge, biological sludge, organic sludge and peaty sludge. Often, sludges occur as a mixture of these different sludges.

Clayey sludges consist primarily of inorganic colloidal particles and are cohesive when dried to a wet soil consistency. Silty sludges consist of particles which are coarser than clay particles and are not cohesive at a wet-soil consistency. Biological sludges are typically an accumulation of various microorganisms from wastewater treatment processes. Peaty sludge consists primarily of fibrous material or a substance having properties similar to peat.

Examples of sludge include primary wastewater sludges, secondary or biological wastewater sludges, waste residues with a high water content, mud, tailings, contaminated sediment, slurry, dredge spoil, etc.

Stabilization—Improvement of the physical properties of sludge using any of the following means: dewatering, drying, biological digesting, composting, hardening, reducing plasticity, reducing cohesion, reducing permeability, and reducing volume change or breakdown tendency in response to climatic changes. This term will be used interchangeably with "physical stabilization."

Solidification—A method of stabilization intended to harden the sludge by mixing hardening reagents into the sludge and curing. Examples of hardening reagents include cement, flyash, lime, lime kiln dust, cement kiln dust, slag, etc.

Fixation—A sludge treatment method intended to reduce the leachability of chemical constituents by inducing certain chemical reactions or change of chemical properties. Fixation is often achieved by mixing dry or liquid reagents (cement, lime, silicate, and various proprietary materials) with sludge. The term fixation will be used interchangeably with "chemical stabilization."

Solidification/Stabilization (S/S)—A class of sludge or other waste treatment method in which both solidification and fixation take place, typically when dry reagents such as cement and lime are added to the waste.

Pond—A contained area designed for disposal or storage of sludges such as lagoons, impoundments, lakes, or landfills.

Drying—Any process of reducing sludge water content by any degree by exposing the sludge surface to the surrounding environment and permitting vaporization of water from the sludge surface.

Sealing—A process of compacting the sludge surface with a light and wide compaction device wherein the irregular sludge surface is smoothed, sludge voids are closed, and the surface sludge mass attains a high density at the given water content and becomes nearly saturated.

Evaporation Opportunity—A qualitative measure of the availability of water at an exposed surface for evaporation. A free water surface is considered to have an evaporation opportunity of 100% while a dry rock surface or a desert sand surface has an evaporation opportunity of 0%.

Water Content—A term which represents the weight of water in a solids-liquid mixture divided by the total weight of the mixture.

Surface Water Content—The water content of the portion of the sludge at the exposed surface of the sludge which is available for surface evaporation.

Solids Content—A term which represents the weight of solids in a solids-liquid mixture divided by the total weight of the mixture.

DETAILED DESCRIPTION

A first embodiment of this invention involves the stabilization of sludge by drying a layer of wet sludge by surface evaporation and then mixing additional wet sludge to the previously dried sludge. Then, further drying of the sludge is accomplished by surface evaporation. The previously dried sludge is used as bulking material to accelerate the drying process. Alternatively, dry soil may be used as bulking material in place of the dried sludge at the beginning of the drying process. This alternative approach is particularly effective when drying biological sludges.

According to another embodiment of the invention, the sludge mixture is periodically tilled. The surface area, the surface water content and the water content of the sludge mixture attained after either mixing or tilling are important factors for this invention. Immediately after mixing or tilling, the surface water content will be the same as the water content of the entire working layer, which is that portion of the sludge which has been mixed or tilled.

In determining the water content (and equivalent surface water content) which the sludge should preferably attain after tilling or mixing with additional wet sludge, a study of the factors involved in surface evaporation is helpful. Two factors that can be controlled by sludge manipulation affect surface evaporation from sludge: (1) evaporation surface area, which is the area of the sludge which is exposed to surrounding atmosphere, and (2) evaporation opportunity, which is the availability of water at the surface of the sludge for evaporation. Surface water content is a quantitative measure of evaporation opportunity. Other factors which affect surface evaporation but are not as easily controlled include solar radiation, air temperature, humidity, sludge color, and wind speed.

In general, as the sludge water content increases, evaporation opportunity also increases. However, above a certain level of water content, evaporation surface area decreases because surface irregularities are eliminated by the flowability of the sludge. For example, if the water content is high enough, the sludge will exist as a thick slurry and form a flat surface area, i.e. the water-rich sludge will be self-leveling.

On the other hand, as water content decreases, evaporation opportunity also decreases because there is less water available to evaporate. However, as water content decreases, the sludge will become self-supporting and evaporation surface area can be increased by the mixing and tilling process. For example, mixing and tilling the self-supporting sludge will form an irregular surface and many voids that make the air-exposed area much greater than the flat surface area.

It has been determined, as indicated by the Examples below, that surface evaporation can be maximized by varying the water content within an operable range which results in a consistency sufficiently self-supporting to significantly increase evaporation surface area while maintaining a sufficient evaporation opportunity by providing a high surface water content at the surface area exposed to the surrounding atmosphere (i.e. the interface surface).

The upper end of the operable range of water content is the highest water content at which the sludge is self-supporting without showing a tendency to flow or be self-leveling. Sludge is self-supporting when it is sufficiently viscous, or flow-resistant, to maintain some degree of surface irregularities and voids after mixing or tilling. For clayey sludges, the upper end of the operable range nearly coincides with the liquid limit as determined by ASTM D-4318.

The lower end of the operable range is the lowest surface water content at which evaporation opportunity is sufficiently high and the lowest water content at which surface sealing is effective. It should be noted that while evaporation rate is solely a function of surface water content, surface sealing effectiveness is a function of water content of the entire working layer. These two values, namely the lowest surface water content at which evaporating opportunity is high and the lowest water content at which surface sealing is effective, are about the same value, i.e., about 20–30% water by weight. For clayey sludges, the lower end of the operable range is between the optimum water content as determined by ASTM D-698 and the plastic limit as determined by ASTMD-4318.

Quantitatively, the operable range of water content is from 20 to 60%, and the preferred range of water content is 30% to 50%. If the water content is too low, an inefficient evaporation rate results because of the lack of water at the evaporation surface. With a water content within the operable range, even though there is less evaporation opportunity than a sludge having a higher water content (e.g. 90% water), the increased surface area of the sludge within the operable range more than compensates for the decreased evaporation opportunity. A water content which is too low results in a sludge which is difficult to seal to restrict precipitation infiltration.

When wet sludge is added to a previously dried sludge layer to form a working layer, the amount of wet sludge added should achieve a water content of the working layer within the operable range, preferably near the upper end of the operable range. As the sludge surface is dried, the water content of the working layer will approach the lower end of the operable range. Then, more wet sludge is added to repeat the process. Periodic tilling may also be used to optimize surface water content and surface area to maximize evaporation.

In this context, "wet sludge" is sludge having a water content at least above the lower end of the operable range. When added to previously-dried sludge, "wet sludge" must have a water content above the water content of the previously-dried sludge. The "working layer" is a layer of a sludge mixture, typically the top six to twelve inches of the surface of the sludge. The working layer is that layer of sludge which is tilled upon drying of the surface of the sludge, or which is mixed with wet sludge.

The frequency of tilling or adding more wet sludge can affect the evaporation rate. In principle, the timing of tilling and adding wet sludge depends on the water contents of the sludge surface and of the entire working layer. When only the surface water content is near the lower end of the operable range, the sludge should be tilled. When the water content of the entire working layer is near the lower end of the operable range, additional wet sludge should be added. As previously stated, after tilling or mixing, the surface water content will initially be the same as the water content of the working layer and should be within the operable range.

Field operators may rely on the observed consistency and appearance of the sludge to determine when to till the sludge and when to add wet sludge. In general, when the surface has become lighter in color and some slight cracking of the surface has occurred due to evaporation, the sludge should be tilled. When the entire working layer has become stiff or crumbly without showing substantial wetness, additional wet sludge should be added. The consistency, at which additional wet sludge should be mixed, corresponds to a water content between the optimum water content and the plastic limit for clayey sludges i.e., the lower end of the operable range. Some particularly hot and arid climates may require adding additional wet sludge once every day, and tilling several times a day.

The step of mixing the sludges may be carried out by any conventional means used for tilling or aerating earthen materials. Preferably, the wet sludge is substantially mixed with the previously-dried sludge to maximize surface evaporation. However, complete mixing is not necessary so long as wet sludge coats broken pieces of dry sludge to increase the evaporation surface area as well as the evaporation opportunity.

Sludges can be mixed and aerated with any suitable equipment such as tillers, horizontal augers, rakes, garden tillers, plows or farm discs. To efficiently cover large drying areas, a tiller/aerator attachment should have a large width. In this regard, the most favorable equipment is a farm tractor with a disc attachment. Also, the aerator equipment should be a light-weight, low ground pressure type if the equipment is used on a sludge pond surface underlain by a thick, soft sludge layer.

According to another embodiment of the invention, incipient precipitation is restricted from infiltrating the sludge by selectively sealing the sludge surface. If not sealed, the tilled sludge will retain rainwater in the matrix and within the irregular depressions and voids formed by tilling. Even with accelerated evaporation achieved by tilling, sludge-drying will take a long time if tilled sludge retains most of rainwater. Thus, minimizing rainwater retention and infiltration in sludge prior to each forecast rainfall event should be an integral part of sludge stabilization for accelerated surface evaporation. The combined effect of accelerated evaporation and restricted infiltration is a large net loss of water. With this water loss, the sludge attains a much smaller volume and a soil-like consistency adequate to support a final cover and construction equipment or economical for the next step management such as transportation, disposal, S/S, or incineration.

An example of effective sealing equipment is shown in FIG. 1. This special attachment includes a plurality of tires 1 mounted on a common axle 2, and can be pulled by a tractor using a suitable frame 3 and a hitch 4. Preferably, a tractor equipped with a farm disc attachment, which can quickly switch to this sealer attachment, is used. As in the case of aeration, the sealer attachment should be as wide as possible to seal a large area within an hour or two.

To seal the sludge surface effectively, the sludge should have a consistency amenable to sealing. At an ideal consistency, the sludge has almost no air void spaces upon one pass of sealing or compaction, deforms and seals easily under the sealing equipment and does not form excessive mudcakes on the sealer attachment. One easy way of testing the sludge for good sealing consistency is walking on it. Firm support, moderate deformation and good sealing under footstep indicate a good sealing consistency. For clayey sludges, the good sealing consistency can be obtained at a water content between the optimum water content and the plastic limit. After some trial and error, the ideal sludge condition can be identified in the field for given sealer equipment and the sludge type. Generally, this water content is from about 20% to 30%.

In the event of a possibly imminent rainfall and a previously-dried sludge requiring tilling or additional wet sludge, one must choose between sealing the sludge to avoid precipitation infiltration versus tilling or mixing additional wet sludge to maximize evaporation. The choice depends upon the likelihood of rainfall, the amount of rainfall forecast, and possible evaporation achievable by tilling or adding wet sludge.

In addition to surface sealing, other measures can promote runoff from the sealed sludge surface, including forming a mild slope towards one end of the working pad area and tracking the sealing equipment along the slope to form shallow channels from higher elevation towards lower elevation. The runoff water should be directed to a retention pond or to the plant wastewater treatment facility.

Even with the sludge surface sealed, rainwater can still "infiltrate" into the sludge when water is present on the sludge surface. Because the sealed sludge surface is almost saturated and very tight, water cannot penetrate readily until some hydrostatic head builds up on the surface of the sludge. The hydrostatic head builds up only if water accumulates on the sludge surface. However, because of quick runoff achieved by sealing and sloped tracks, a minimal hydrostatic head may build up during actual rainfall. Assuming 720 hours (30 days) of annual raining time and a permeability coefficient of $1\times10^{6}$ cm/sec for the sealed sludge, annual rainwater infiltration per unit area can be estimated as follows:

$$q=(k)\ (i)\ (t)=0.034\times1.0\times30=1.0 \text{ inch}$$

Where, q=infiltration of water in depth (in)

k=permeability, $1\times10^{-6}$ cm/sec=0.034 in/day i=hydraulic gradient (1.0 for surface infiltration into saturated sludge)

t=infiltration time, 30 days

This result indicates that annual rainwater infiltration into a sealed and tracked sludge surface is very small. For the field operational conditions, however, the total retention and infiltration could be much higher for several reasons. For example, sealing may not be carried out in the event of unexpected thunderstorms, daily squalls or trace rainfalls for which surface sealing is not practical. Furthermore, there may be insufficient time to seal the entire sludge surface or the sealing of the sludge surface may not be perfect. Additional sources of the presence of water include minor depressions which cause ponding of small areas and spring snowmelt which extend the time of water presence. The annual retention/infiltration depth, considering the above conditions, is estimated to be between 10 to 20% of the annual precipitation.

The general steps of one implementation of the present invention include the following: (1) create a stable working pad; (2) spread wet sludge over the dried sludge on the working pad; (3) mix the wet sludge with the underlying dried sludge and aerate the mixed sludge until the sludge becomes substantially dry and stable; (4) seal the sludge surface with suitable roller equipment prior to possibly imminent rainfall events; (5) repeat steps 2 and 3, and occasionally step 4 as necessary, until all sludge is stabilized.

Implementation of the present invention requires tilling and sealing equipment operating on the working pad for aerating and sealing. Therefore, the working pad should be sufficiently stable to support such equipment. A stable working pad can be created by one or a combination of the following methods.

A first method to create a stable working pad is to subdivide the pond into two cells, one small and one large, and consolidate all sludge into the large cell. The empty small cell can now be used as a working pad. The pond can be subdivided using a dike, sheet piles, or in-situ solidification of a strip of sludge. This approach is feasible for a relatively large pond with some freeboard.

Another method of creating a stable working pad is useful if multiple cells exist. Here, one cell may be emptied by transferring its contents to other cells. This empty cell can be used as a working pad. By the time this cell is full with the stabilized sludge in accordance with the present invention, at least one other cell will be empty for successive sludge stabilization.

Another method of creating a stable working pad includes building a new pond and beginning the method of the present invention at the bottom of the new pond. In this case, a desirable operation mode is to discharge the new sludge to an existing pond and the old sludge to the new pond for sludge stabilization in accordance with the present invention. In this way, the old sludge with higher solids content can be stabilized efficiently while the new sludge with lower solid content settles in the old pond and attains a higher solid content. By the time the new pond is filled with stabilized sludge, an old pond will be empty and ready for further sludge stabilization.

Figure 2:
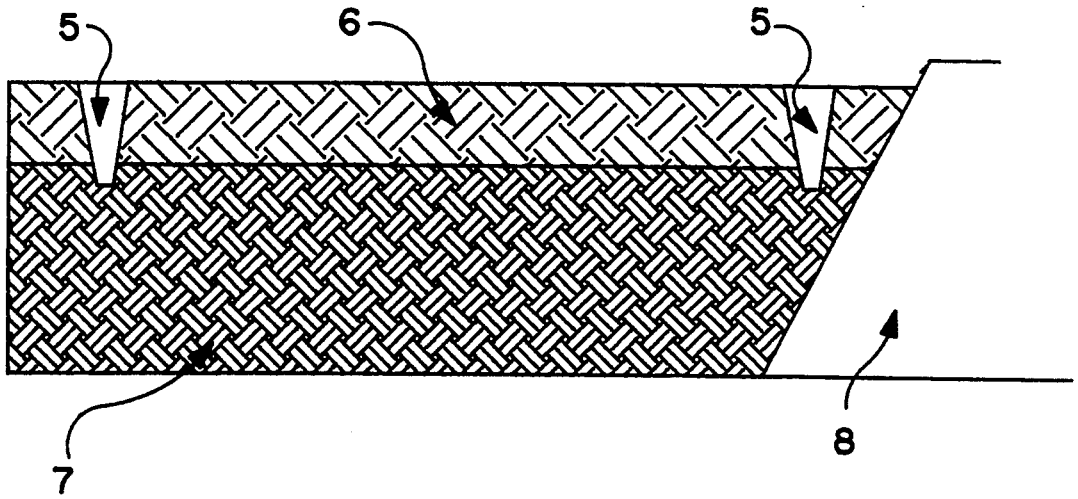
FIG. 2 is a cross sectional view of a stable working pad for use with the present invention, based on a thick crust layer formed by ditches.

Another method of creating a stable working pad involves creating a thick crust by draining the pond surface using a network of ditches. In FIG. 2, a plurality of ditches 5 are shallow initially and deepened as a stable crust 6 is formed on the surface of soft sludge 7 contained by dike 8. Because the rainwater is quickly drained and the water table in the sludge is lowered by these ditches, the sludge surface dries rapidly and forms a crust. This crust grows thicker as the ditches are deepened. When the crust 6 becomes sufficiently thick, it can support light equipment required for operation of the present invention. This method is ideal for a pond with sufficient sludge thickness and sludges showing high crust strength, such as red mud, dredge spoil, and other inorganic sludges. As stabilized sludge 9 builds up on the working pad 10 (FIG. 3*b*), the hearty stable sludge will slowly sink into the underlying soft sludge 7 and push the soft sludge away from under the working pad 10.

Figure 3A:
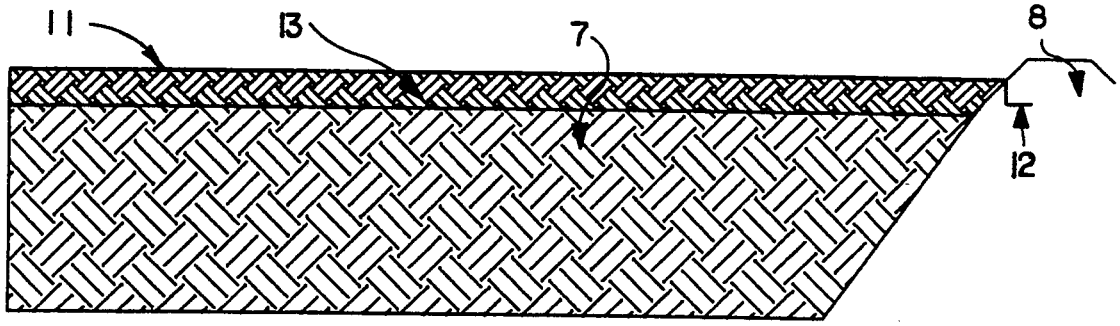
FIG. 3 is a cross-sectional view of a floating pad for use with the present invention.
Figure 3B:
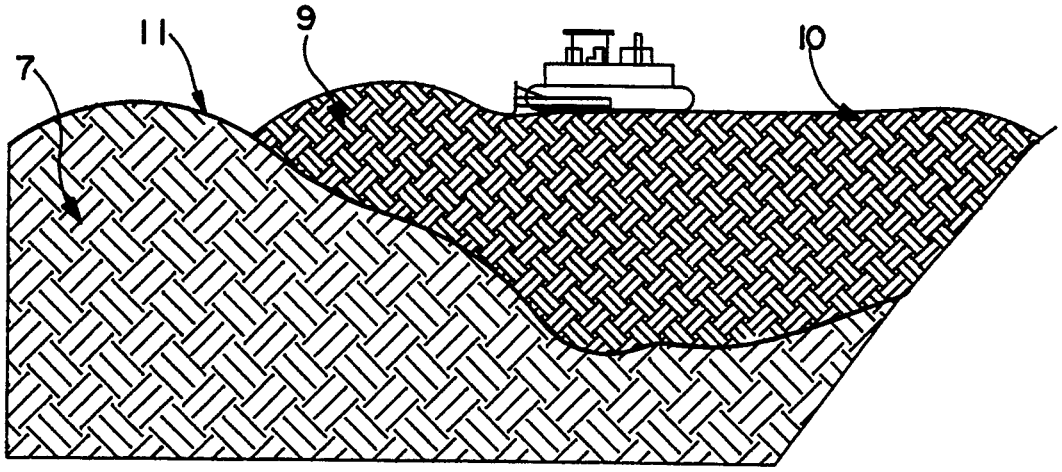

As shown in FIG. 3*a*, a method of creating a floating pad involves placing a layer of a high strength geotextile 11 and an anchor 12 over a weak or thin crust layer 13. The anchor 12 secures the geotextile 11 onto the stable dike 8. In FIG. 3*b*, stabilized sludge 9 is pushed over the floating pad. This floating pad can support light equipment for sludge stabilization of the present invention. As stabilized sludge 9 builds up on the floating pad 10, the heavy stable sludge together with the floating pad will slowly sink into the underlying soft sludge 7 and push the soft sludge away from under the pad.

Figure 4A:
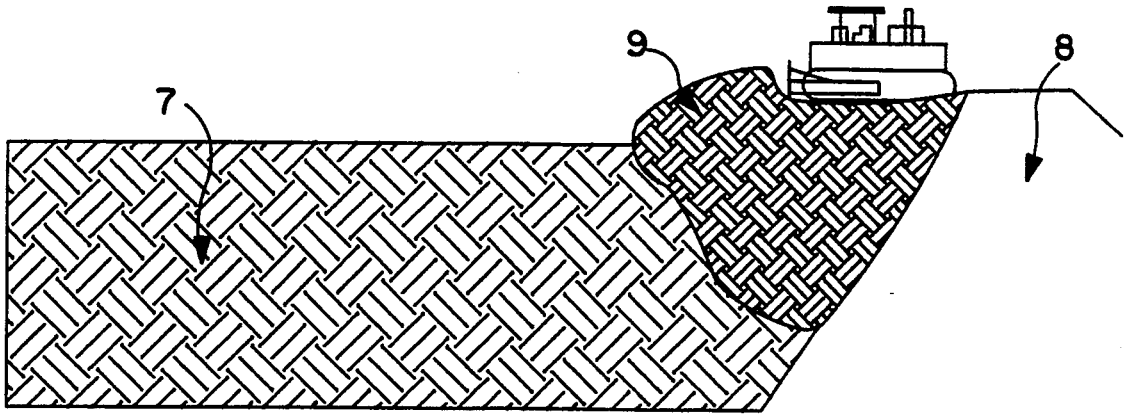
FIG. 4 is a cross-sectional view of the displacement or mud waving method for use with the present invention.
Figure 4B:
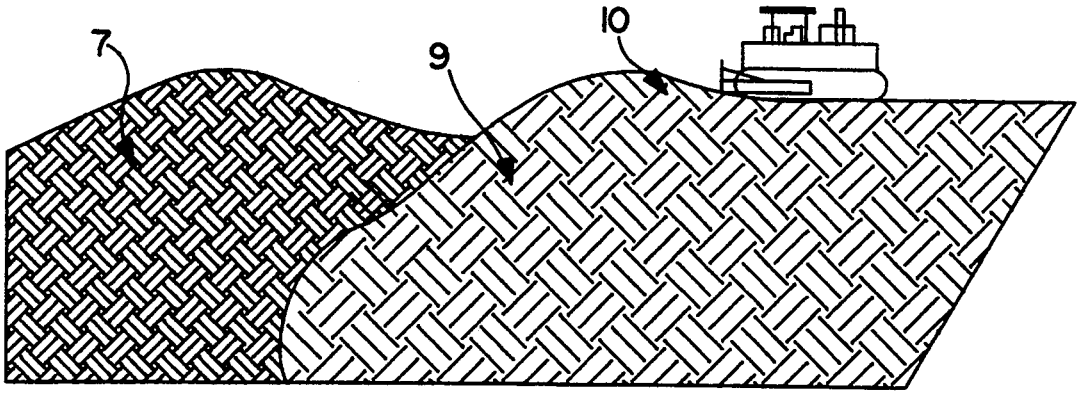

Another method for creating a stable working pad is the displacement or mud waving method, as shown in FIG. 4*a*. In this method, the stabilized sludge 9 is dumped from the dike 8 and pushed into the pond. As this dumping and pushing continues, the stabilized material 9 sinks into the unstabilized soft sludge 7 and pushes the unstabilized sludge away from the dumping area. Initially, the sludge crust or stabilized sludge from other areas is used for displacement. When a reasonable area is secured by displacement as shown in FIG. 4*b*, this area 10 is used as a working pad for subsequent sludge stabilization in accordance with the present invention.

Finally, a working pad may be created by conventional solidification over a limited area of the pond or one may build a temporary pad outside the sludge pond.

With regard to spreading sludges on the working pad, sludge is first removed from a pond either by pumping or by excavation. Whenever possible, pumping is the most economical way of sludge removal and transfer.

Because most sludges exhibit thixotropy, seemingly thick and stable sludges can be made fluid for pumping by agitating. Another advantage of pumping is easier spreading of sludges over the entire working area using pipes, hoses and discharge ports. If sludge has to be removed by an excavator, an amphibious dragline or similar equipment can be used to cast the removed sludge over a relatively large area. The mixing and tilling process will further spread the sludge over a larger area.

The steps of mixing, tilling, and sealing may be repeated as necessary until all of the sludge required to be stabilized is sufficiently dried. During these steps, the stable, dried layer supports the equipment handling the soft, wet sludge on the surface.

When the surface layer is sufficiently dried, it becomes part of the working pad and a new, wet surface layer is created. The equipment traffic helps compaction of the dried layers to attain a higher density and lower volume. The step of sealing the sludge may be repeated as necessary in the event of a possibly imminent rainfall. In the northern states where winter evaporation is minimal, the sludge surface should be sealed and the entire operation should be ceased between the late fall and the early spring.

One application of the present invention is the stabilization of sludges for pond closure with sludges remaining in place. Once the entire pond content is stabilized by the present invention, it is a simple matter to install a final cover because the stabilized sludge can now support the final cover as well as cover installation equipment. A typical cover consists of a two-foot soil cover, a drainage layer, a flexible membrane and a two-foot clay liner.

Since this invention dries sludges to a soil-like consistency, the final water content in the stabilized sludge will be typically about 20–30%. The resultant weight and volume reduction, hence the subsequent disposal or treatment cost reduction, is drastic. Table 2 presents the performance of this invention as compared to the performance of the S/S process and mechanical dewatering in terms of weight and volume reduction for a water treatment sludge having an initial solids content of 10% and solid specific gravity of 2.5. As shown, the performance of this invention is far superior to other methods. Even for a sludge having as high as 45% solid content in a pond, the process described in this invention can reduce the volume to 50% of the original volume wherein a 100% increase in the pond operating life is achieved. Because of this superior performance at low costs, the analysis indicates that this invention can reduce the total project cost by 50 to 70% for almost all large sludge projects requiring a multimillion dollar solution.

TABLE 2

| Weight and Volume Reduction Performance | | | |
|---|---|---|---|
| Method | Weight (lbs) | Volume (cubic feet) | Final Vol. (% original) |
| Original Sludge (1) | 100 | 1.5064 | 100 |
| Mech dewatering (2) | 40 | 0.5449 | 36.2 |
| S/S process (3) | 120 | 1.6570 | 110 |
| This Invention (4) | 14.3 | 0.1398 | 9.3 |

Notes:
(1) A water treatment sludge with a solids content of 10% and solid specific gravity of 2.5.
(2) Based on the cake solid content of 25%.
(3) Based on the typical S/S process performance for similar sludges producing the final weight 20% and final volume 10% more than the original sludge.
(4) Based on the final water content of 30%, and final stabilized sludge having about 5% of air void.

Sludges often require treatment by various costly methods even after dewatering or drying. For example, certain sludges containing high levels of heavy metals require solidification/stabilization and other sludges with high levels of toxic organics require incineration. The unit costs of these treatment methods are highly dependent on the water content of sludge: The higher the water content, the higher the treatment unit cost. The present invention is therefore an effective pretreatment step to other expensive treatment processes.

In addition to lowering the unit cost, a method in accordance with the present invention also reduces the total volume to 10 to 50% of the original volume, depending on the initial water content and the specific gravity of solids. The combined effect of lower water content and smaller volume decreases the total project cost drastically. For example, the present invention can be used as a pretreatment step to fixation to reduce the total project cost to less than 50% of the total project cost otherwise. Fixation can be performed in situ by adding reagent over each lift of sludge at the end of each drying cycle. In addition, the smaller volume of waste can be contained in a smaller area with a less final cover cost. Thus, the total project cost by this two-step process may be less than 50% of the normal cost based on total treatment and full cover without using the method of the present invention.

Figure 5:
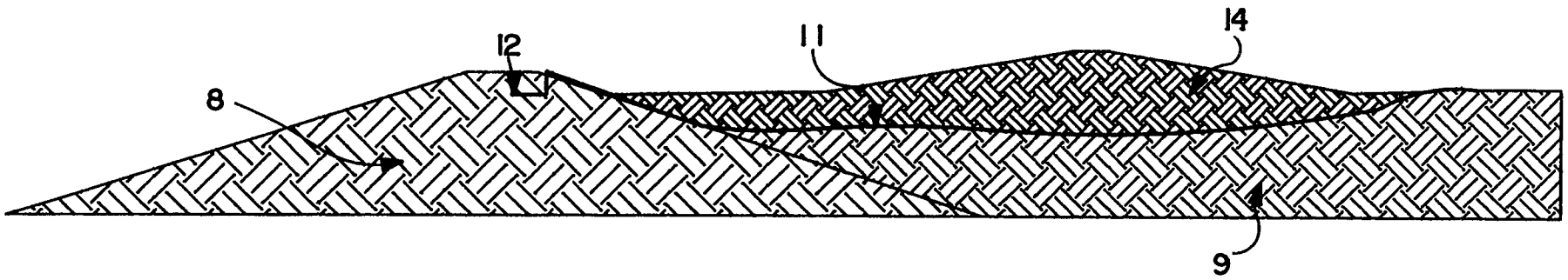
FIG. 5 is a cross-sectional view showing the vertical expansion of a pond in accordance with the present invention.

As previously stated, the volume reduction achieved by the present invention increases the sludge pond life typically by 100% or more. When this capacity is again filled up with the stabilized sludge, the pond can be expanded further vertically. FIG. 5 shows this vertical expansion, with or without a geotextile reinforcement 11 and anchor 12, by building a new second story dike 14 inside a pond filled up with stabilized sludge 9. The height of the new dike 14 may be much lower than the original dike 8 but the second level pond can provide a capacity equivalent to the original pond life. This is because the second level pond with 30% of the original pond capacity can receive sludges, based on operation of the present invention, equivalent to 100% of the original pond capacity without using the method of the present invention. Thus, an increase in operating life of about 200% can be easily achieved by in-pond volume reduction and vertical expansion. Where the site conditions permit, a third or fourth story pond is also possible to further increase the pond capacity.

When more than one pond requires closure, the contents of all ponds may be consolidated into a lesser number of ponds for final closure. This is possible because of a large volume reduction achieved by the present invention. This consolidation creates a usable land area and reduces the capping cost for the final disposal area. Likewise, even a single pond may be closed by consolidating the total sludge into a smaller area.

Organic sludges tend to emit an objectionable odor. Also, organic chemical sludges often emit volatile compounds above the acceptable health and environmental standards. The mixing and tilling steps of this invention will greatly increase odor and volatile chemical emission, requiring specific control methods.

Odor and volatile emission from organic sludges can be controlled by organic binders such as activated carbon powder, carbon-rich coal ash, off-specification carbon black, manufactured organophillic clay or lime. An organic binder is a material with a strong tendency to adsorb organic compounds. Thus, an organic binder immobilizes volatile organic compounds, thereby reducing the emission of the organic compounds during the mixing and tilling steps of this invention. Selection and the application rate of a specific binder will depend on the type of sludge, desired binder performance and binder cost.

For liquid-like dilute sludges, the powdery organic binder would be applied to the sludge pond and mixed with the sludge using sludge pumps or dredging machines in the pond. Alternatively, the binder powder may be mixed with the sludge in a mixer tank. For any sludges which can be pumped, the binder may be added to the sludge pump feed line. In these cases, the binder will easily disperse into the liquid-like sludge during mixing or be mixed with the sludge during pumping. As a result, the sludge will have greatly reduced levels of odor and volatile emission during the process of this invention.

For dense sludges requiring excavators for removal and handling, the binder material may be applied on the excavation face. In this case, the overall level of odor and emission control would not be as good as the liquid mixing or pump feeding because of inefficient mixing of the binder with the dense sludge.

Organic sludges often require organic binders to immobilize organic chemicals as part of the typical S/S process. By incorporating an organic binder during the process of this invention, the following S/S step may not require any organic binder. For certain sludges, this process incorporating an organic binder can accomplish the objective of the S/S process without actually performing the S/S step, thereby eliminating the need for the S/S step altogether.

Using two working pads may solve the odor and emission problems. The first working pad could be enclosed in a greenhouse or fabric dome wherein high odor emission during the initial operation is contained and controlled. Preferably, the greenhouse is transparent so that solar radiation, a factor in evaporation can reach the sludge surface. However, the greenhouse does not necessarily have to be transparent if a higher evaporation rate is not initially needed, or desired. After the level of emission is sufficiently lowered, the sludge would be transferred outdoors to the second working pad for further reduction of water content.

EXAMPLE

A white, rectangular plastic container was filled with soil (to simulate an inorganic sludge with a high solid content) and an identical container with tap water. These containers were 28.3 centimeters (cm) wide, 33.7 cm long, and 17.0 cm deep. A horizontal line was drawn 4 cm from the top of each container. This line was to mark the beginning volumes of soil and water. The nominal evaporation surface area of each container was 940.0 square cm.

At the beginning of experiment, the water container was filled to the marker and weighed. The soil container was filled with a grayish brown silty clay made wet by adding water, and weighed. The total weight of the water container and water was 17.5 lbs. The total weight of the soil container and soil was 20.0 pounds.

A 240-milliliter plastic bottle was used to add measured volumes of water to the soil and water containers. Both containers were placed outside on a wooden deck facing the Southwest and were exposed to meteorological conditions. To collect stable and realistic data, the experiment was performed over a 50 day period (from Jun. 30, 1990 to Aug. 22, 1990 with 4 days of temporary suspension) in West Chester, Pa. For the duration of the experiment, the containers received sunlight from late morning (approximately 10:30 a.m. in early July to 11:00 a.m. in mid-August) to sunset.

The two containers were checked approximately every thirty minutes to two hours, depending on the weather conditions, during the daylight hours. No observation was made from sunset to about 8:00 a.m. of next morning. Based on visual observation, evaporation from wet soil during the nighttime was insignificant.

The soil was checked for wetness and consistency. The soil was tilled with a garden spade if the top layer was noticeably drier than the remainder. If entire soil became noticeably dry, then a known volume of water was added to re-wet the soil. Soil dryness was judged visually. The soil was judged dry when it became hard to till with the spade and the tilled surface became loose and crumbly. At this stage, the soil was still moist but not sufficiently moist for a high evaporation opportunity. Wet soil, which resulted after adding water, was soft, showed traces of free water on the soil surface, and easy to till with the spade.

When the water level in the water container fell visibly due to evaporation, a known volume of water was added to raise the water level to the marker on the container. Each time water was added to the soil or water container, the volume of water added and the time were recorded.

This daily procedure included a few exceptions. When a part of the soil surface was covered with water after heavy rainfall events, the excess water was drained from the soil container and an equal volume of water was drained from the water container. This was necessary to maintain the soil surface area exposed for evaporation. To avoid this unnecessary step, the containers were covered with a plastic sheet during the subsequent rainfall events. The estimated rainwater retained in the containers, after draining excess water, is estimated to be about 2 cm. The daily procedure was suspended for four days (namely 29, 30, and 31 Jul. 1990 and 18 Aug. 1990) when no caretaker was available. In this case, both containers were brought indoors and covered with plastic sheets to prevent evaporation.

Table 3 shows a summary of evaporation depth from both containers. The evaporation data is also plotted in FIG. 6. The daily evaporation depth was calculated by dividing the daily volume of water (ml) added to each container by the evaporation surface area (940 sq. cm.). It should be noted that a volume of water added on a particular day does not necessarily represent the volume that has actually evaporated on that day. However, over an extended period of experiment time, the total volume of water added would be equivalent to the total volume that has evaporated.

TABLE 3

| Evaporation Data Summary | | | | |
|---|---|---|---|---|
| | Evaporation from Soil (cm) | | Evaporation from Water (cm) | |
| Day Number | Daily | Cumulative | Daily | Cumulative |
| 1 | 0.77 | 0.77 | 0 | 0.00 |
| 2 | 0.51 | 1.28 | 0 | 0.00 |
| 3 | 0.51 | 1.79 | 0.89 | 0.89 |
| 4 | 0.51 | 2.30 | 0.51 | 1.40 |
| 5 | 1.02 | 3.32 | 0 | 1.40 |
| 6 | 0.51 | 3.83 | 0.89 | 2.29 |
| 7 | 0.51 | 4.34 | 0.26 | 2.55 |
| 8 | 0.77 | 5.11 | 0.51 | 3.06 |
| 9 | 0.51 | 5.62 | 0.51 | 3.57 |
| 10 | 0.77 | 6.39 | 0.26 | 3.83 |
| 11 | 0.26 | 6.65 | 0.26 | 4.09 |
| 12 | 0 | 6.65 | 0 | 4.09 |
| 13 | 0 | 6.65 | 0 | 4.09 |
| 14 | 0 | 6.65 | 0 | 4.09 |
| 15 | 0 | 6.65 | 0 | 4.09 |
| 16 | 0 | 6.65 | 0 | 4.09 |
| 17 | 0 | 6.65 | 0 | 4.09 |
| 18 | 0.26 | 6.91 | 0 | 4.09 |
| 19 | 1.02 | 7.93 | 0.51 | 4.60 |
| 20 | 0.77 | 8.70 | 0.51 | 5.11 |
| 21 | 0.51 | 9.21 | 0.51 | 5.62 |
| 22 | 0.77 | 9.98 | 0.51 | 6.13 |
| 23 | 0 | 9.98 | 0.51 | 6.64 |
| 24 | 0.51 | 10.49 | 0.51 | 7.15 |
| 25 | 0.77 | 11.26 | 0.13 | 7.28 |
| 26 | 0.77 | 12.03 | 0.64 | 7.92 |
| 27 | 0.77 | 12.80 | 0.51 | 8.43 |
| 28 | 0.51 | 13.31 | 0 | 8.43 |
| 29 | 0.51 | 13.82 | 1.02 | 9.45 |
| 30 | 1.02 | 14.84 | 0.51 | 9.96 |
| 31 | 1.02 | 15.86 | 0.64 | 10.60 |
| 32 | 0.77 | 16.63 | 0.51 | 11.11 |
| 33 | 1.02 | 17.65 | 0.51 | 11.62 |
| 34 | 0 | 17.65 | 0 | 11.62 |
| 35 | 0 | 17.65 | 0 | 11.62 |
| 36 | 0 | 17.65 | 0 | 11.62 |
| 37 | 0.26 | 17.91 | 0.26 | 11.88 |
| 38 | 0 | 17.91 | 0 | 11.88 |
| 39 | 0.26 | 18.17 | 0 | 11.88 |
| 40 | 0.26 | 18.43 | 0.26 | 12.14 |
| 41 | 0.77 | 19.20 | 0.51 | 12.65 |
| 42 | 0.77 | 19.97 | 0.77 | 13.42 |
| 43 | 1.02 | 20.99 | 0.51 | 13.93 |
| 44 | 0.51 | 21.50 | 0.26 | 14.19 |
| 45 | 0.77 | 22.27 | 0.77 | 14.96 |
| 46 | 0.77 | 23.04 | 0 | 14.96 |
| 47 | 0.51 | 23.55 | 0.26 | 15.22 |
| 48 | 0.26 | 23.81 | 0.51 | 15.73 |
| 49 | 0 | 23.81 | 0 | 15.73 |
| 50 | 0 | 23.81 | 0 | 15.73 |

During extended rainy and humid periods (e.g., from July 10 to July 17 and from August 5 to August 11), very little or no water was added. Sometimes, as mentioned above, some rainwater was drained after heavy rainfalls. In Table 3, this drained excess water was recorded as "0.00."

The typical evaporation depth during sunny, hot days was 0.77 cm from the soil surface and 0.51 cm from the water surface. The total evaporation during the fifty-day experiment was 23.81 cm from the soil surface and 15.22 cm from the water surface. Considering 2 cm of rainwater retained in the containers after heavy rainfall, the actual total evaporation depth from the soil and water surfaces would be 25.81 cm and 17.22 cm, respectively.

Figure 6:
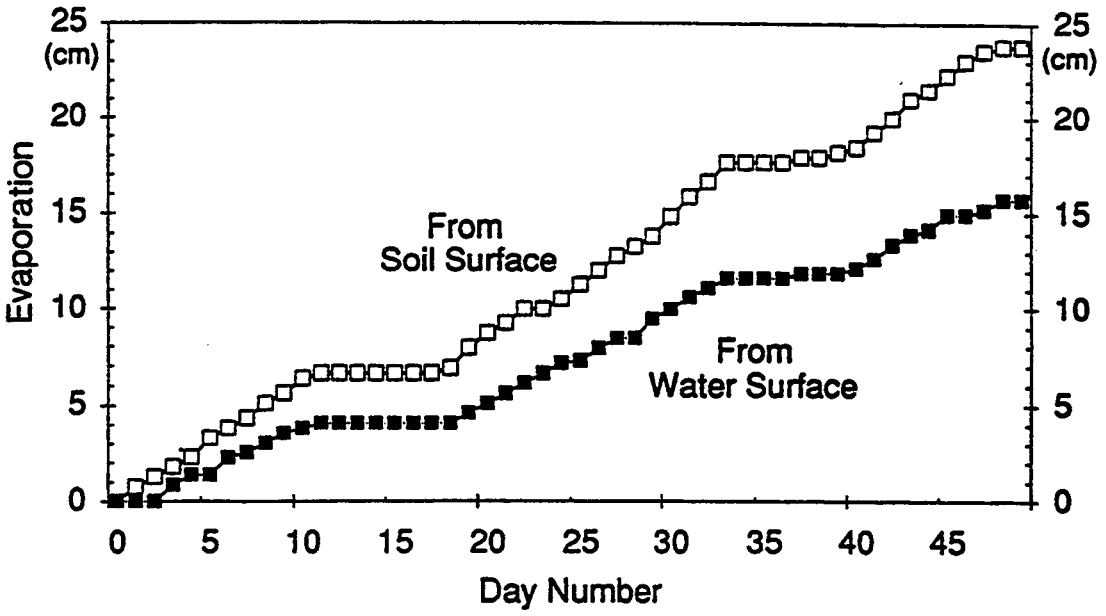
FIG. 6 is an experimental data plot of evaporation versus days for two pans, one containing only water and the other containing soil and water which was periodically tilled in accordance with the present invention.

In FIG. 6, the two flat intervals on the cumulative evaporation plots indicate extended rainy periods during which no or little water was added. Excluding these flat intervals, the evaporation trends are consistent and represent evaporation during normal periods (i.e., dry days with occasional rainy and cloudy days). The daily evaporation rates from these normal periods are approximately 0.71 cm per day from the soil surface and approximately 0.47 cm per day from the water surface, calculated from the slope of the steep intervals.

The results of this experiment indicate that evaporation from wet and tilled soil surfaces greatly exceeds evaporation from water surfaces in a similar setting. The cumulative evaporation depth from the soil surface was approximately 150% of evaporation from the water surface. Because the soil surface evaporation opportunity during this experiment was less than 100 percent, the greater evaporation from the soil surface can be attributed to the larger evaporation area achieved by tilling.

Based on the results of the evaporation experiment and infiltration estimates for sealed sludge surfaces, the following general water balance principles can be established. The evaporation rate from sludge or soil surface can be accelerated to about 150% of the shallow lake evaporation. The infiltration/retention depth of rainfall in the sealed sludge surface, even considering field irregularities, can be controlled within 10 to 20% of the annual rainfall. For initial planning purposes, this principle may be directly applied to any locality. However, a site-specific pilot test is required to develop performance data before actual implementation of actual projects.

Using the published precipitation and shallow lake evaporation data (Linsley, et. al., 1975, FIG. 3–14 for precipitation and FIG. 5–7 for shallow lake evaporation), Table 4 presents estimated annual net water loss by the present invention for four regions. The water loss estimates are based on 150% of shallow lake evaporation for sludge surface evaporation and 15% of annual precipitation for rainwater retention and infiltration. As evident by comparing Tables 1 and 4, the performance of the present invention is superior to that of the Paved Drying Bed performance.

TABLE 4

Net Water Loss by Present Invention vs. Paved Drying Bed (PDB) (inch/year)

| | Savannah Georgia | Madison Wisconsin | Forth Worth Texas | Phoenix Arizona |
|---|---|---|---|---|
| (1) Lake Evap | 44 | 30 | 60 | 72 |
| (2) ESS Evap | 66 | 45 | 90 | 108 |
| (3) Precipitation | 48 | 32 | 28 | 8 |
| (4) Rewetting | 7 | 5 | 4 | 1 |
| (5) Net Water Loss | 59 | 40 | 86 | 107 |
| (6) PDB Water Loss | 1 | −1 | 28 | 54 |

Notes:
(1) Lake evaporation from Linsley, et. al., FIG. 5–7
(2) ESS Evaporation = Lake Evaporation × 1.5
(3) Precipitation from Linsley, et. al., FIG. 3–14
(4) Rewetting depth = 0.15 × Precipitation
(5) Net water loss = ESS Evaporation − Rewetting depth
(6) PDB water loss from Table 1

Based on the typical phase relationship of the raw sludge and stabilized sludge, a net water loss of 40 inches a year (Madison, Wis.) is equivalent to about a 67-inch thick sludge layer stabilized to about 27-inch thick soil-like material. At 86 inches of annual net water loss (Fort Worth, Tex.), the present invention can stabilize more than 11 feet of inorganic sludge with a 20% solids content by volume.

In contrast to the paved drying bed method, the present invention is effective even in humid regions where annual precipitation significantly exceeds annual (shallow lake) evaporation. This is a major reversal of the common belief that sludges cannot be effectively dewatered by solar evaporation in humid regions. The net water loss by the present invention is so high that it can be applied to sludge disposal ponds with a large accumulation of sludge. The process of the present invention is a reliable method to plan, design and implement because of two major reasons: (1) Annual evaporation from the shallow lake, hence from the sludge surface, is relatively stable without large variations for any region; and (2) extreme rainfall events (e.g., 12 inches of rain in a day) will not significantly impact the performance of the present invention due to effective control measures (sealing, sloped track, etc.).

EXAMPLE 2

In 1992, another experiment was performed to demonstrate that the findings from the 1990 experiment can be repeated for a real sludge and at a different time. The sludge sample was obtained from a local water filtration plant that generates sludge from the sedimentation process using ferric chloride as flocculant. This experiment was performed for a period of 29 days (from Aug. 20, 1992 to Sep. 20, 1992 with 3 days off). Except for the test material and time, all other procedures and methods were identical to the procedures and methods of Example 1. Table 5 presents the results of the 1992 experiment indicating that the evaporation rate from the sludge surface is about 150% of the water surface evaporation rate. These results demonstrate that the method of the present invention significantly increases evaporation from sludge, as well as from a soil-water mixture.

TABLE 5

Evaporation Data from the Second Experiment

| | Evaporation from Soil (cm) | | Evaporation from Water (cm) | |
|---|---|---|---|---|
| Day No. | Daily | Cumulative | Daily | Cumulative |
| 1 | 0.64 | 0.64 | 0.00 | 0.00 |
| 2 | 0.64 | 1.28 | 0.43 | 0.43 |
| 3 | 0.64 | 1.92 | 0.43 | 0.86 |
| 4 | 0.64 | 2.56 | 0.64 | 1.50 |
| 5 | 0.43 | 2.99 | 0.43 | 1.93 |
| 6 | 0.64 | 3.63 | 0.43 | 2.36 |
| 7 | 0.21 | 3.84 | 0.00 | 2.36 |
| 8 | 0.43 | 4.27 | 0.43 | 2.79 |
| 9 | 0.64 | 4.91 | 0.43 | 3.22 |
| 10 | 0.64 | 5.55 | 0.43 | 3.65 |
| 11 | 0.64 | 6.19 | 0.43 | 4.08 |
| 12 | 0.43 | 6.62 | 0.43 | 4.51 |
| 13 | 0.00 | 6.62 | 0.00 | 4.51 |
| 14 | 0.21 | 6.83 | 0.00 | 4.51 |
| 15 | 0.21 | 7.04 | 0.21 | 4.72 |
| 16 | 0.00 | 7.04 | 0.00 | 4.72 |
| 17 | 0.00 | 7.04 | 0.00 | 4.72 |
| 18 | 0.21 | 7.25 | 0.21 | 4.93 |
| 19 | 0.21 | 7.46 | 0.00 | 4.93 |
| 20 | 0.43 | 7.89 | 0.32 | 5.25 |
| 21 | 0.43 | 8.32 | 0.32 | 5.57 |
| 22 | 0.64 | 8.96 | 0.32 | 5.89 |
| 23 | 0.43 | 9.39 | 0.32 | 6.21 |
| 24 | 0.21 | 9.60 | 0.00 | 6.21 |
| 25 | 0.64 | 10.24 | 0.43 | 6.64 |
| 26 | 0.43 | 10.67 | 0.43 | 7.07 |
| 27 | 0.43 | 11.10 | 0.21 | 7.28 |
| 28 | 0.43 | 11.53 | 0.32 | 7.60 |
| 29 | 1.57 | 13.10 | 1.21 | 8.81 |

Note:
The last day values include the weight difference between the start and end of the testing period.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A method of stabilizing wet sludge comprising the steps of:

drying a layer of wet sludge by surface evaporation;

adding additional wet sludge to said previously-dried layer and mixing said additional wet sludge with said previously-dried layer to form a wet sludge mixture having a water content within an operable range which permits said wet sludge mixture to have a self-supporting consistency wherein the mixing process creates irregular surfaces and voids within said wet sludge mixture to significantly increase evaporation surface area while maintaining a sufficiently high surface water content, wherein the combined effect of the increased evaporation surface area and the sufficiently high surface water content is to maximize surface evaporation; and drying said wet sludge mixture by surface evaporation to form a substantially dried sludge mixture.

2. A method in accordance with claim 1 wherein said method further comprises the step of periodically tilling said first layer of wet sludge to significantly increase evaporation surface area while maintaining a sufficiently high surface water content, wherein the combined effect of the increased evaporation surface area and the sufficiently high surface water content is to maximize surface evaporation.

3. A method in accordance in claim 1 further comprising restricting precipitation from infiltrating any of said sludge mixtures by selectively sealing the surface of said sludge mixtures by light compaction.

4. A method in accordance with claim 3 wherein the step of restricting precipitation occurs when any of said sludge mixtures has a water content between the 20 and 30%.

5. A method in accordance with claim 4 wherein the step of restricting precipitation includes compacting any of said sludge mixtures by rolling a plurality of tires mounted on a common axle over any of said sludge mixtures, said axle carrying bearing weight sufficient to effect sealing of said mixture.

6. A method in accordance with claim 5 wherein the step of restricting precipitation further includes forming a mild slope on the surface of any of said sludge mixtures and forming a track within said mild slope to form channels from higher elevation to lower elevation to promote water runoff.

7. A method in accordance with claim 1, wherein the step of drying said wet sludge mixture includes periodically tilling said wet sludge mixture to enhance evaporation from said wet sludge mixture.

8. A method in accordance with claim 1 further comprising the step of covering said substantially dried sludge mixture with a final cover.

9. A method in accordance with claim 1 further comprising the step of solidifying said substantially dried sludge mixture.

10. A method in accordance with claim 1 further comprising the step of chemically stabilizing said substantially dried sludge mixture.

11. A method in accordance with claim 1 further comprising transporting and disposing of said substantially dried sludge mixture.

12. A method in accordance with claim 1 wherein said wet sludge mixture has a water content between 20% and 60% immediately after the step of mixing.

13. A method in accordance with claim 1 wherein the step of drying said wet sludge mixture includes:

drying said wet sludge mixture by surface evaporation to form a dried sludge mixture; and mixing additional wet sludge with said dried sludge mixture to form a second wet sludge mixture having a water content within an operable range which permits said second wet sludge mixture to have a self-supporting consistency, wherein the mixing process creates irregular surfaces and voids within said second wet sludge mixture to significantly increase evaporation surface area while maintaining a sufficiently high surface water content, wherein the combined effect of the increased evaporation surface area and the sufficiently high surface water content is to maximize surface evaporation; and successively repeating the steps of drying said wet sludge mixture and mixing a sufficient amount of additional wet sludge with said dried wet sludge mixture.

14. A method of stabilizing wet sludge comprising the steps of:

drying an exposed layer of wet sludge by surface evaporation;

periodically tilling said previously-dried exposed layer to form an altered exposed layer having a self-supporting consistency, wherein the tilling process significantly increases evaporation surface area while maintaining a sufficiently high surface water content, wherein the combined effect of the increased evaporation surface area and the sufficiently high surface water content is to maximize surface evaporation; and restricting precipitation from infiltrating any of said exposed layers by selectively sealing said exposed layers by compacting any of said exposed layers to prevent infiltration by said precipitation.

15. A method in accordance with claim 14 wherein the step of restricting precipitation occurs when any of said exposed layers have a water content between 20% and 30%.

16. A method in accordance with claim 15 wherein the step of restricting precipitation further includes compacting any of said exposed layers by rolling a plurality of tires mounted on a common axle over any of said exposed layers, said axle carrying bearing weight sufficient to effect compaction of said exposed layers.

17. A method in accordance with claim 16 wherein the step of restricting precipitation further includes forming a mild slope on the surface of any of said exposed layers and forming a track within said mild slope to form channels from higher elevation to lower elevation to promote water runoff.

18. A method in accordance with claim 14 wherein said altered exposed layer has a surface water content between 20% and 60% immediately after the step of tilling.

19. A method of stabilizing wet sludge comprising the steps of:

drying a layer of wet sludge by surface evaporation;

adding additional wet sludge to said previously-dried layer and mixing said additional wet sludge with said previously-dried sludge to form a wet sludge mixture having a water content between 20% and 60%; and drying said wet sludge mixture by surface evaporation to form a substantially dried sludge mixture.

20. A method in accordance with claim 19 wherein the water content of said wet sludge mixture is between 30% and 50% after the step of mixing.

21. A method of stabilizing wet sludge comprising the steps of:

mixing wet sludge with dry soil to form a wet sludge mixture having a self-supporting consistency wherein the mixing process creates irregular surfaces and voids within said wet sludge mixture to significantly increase evaporation surface area while maintaining a significantly high surface water content, wherein the combined effect of the increased evaporation surface area and the sufficiently high surface water content is to maximize surface evaporation; and drying said wet sludge mixture by surface evaporation.

22. A method of stabilizing wet, clay-like sludge comprising the steps of:

drying a first layer of wet, clay-like sludge by surface evaporation;

adding additional wet, clay-like sludge to said first layer and mixing said additional wet, clay-like sludge with said first layer to form a wet, clay-like sludge mixture having a water content between the liquid limit and the plastic limit of said wet, clay-like sludge mixture; and drying said wet, clay-like sludge mixture by surface evaporation.

23. A method in accordance with claim 1 wherein said wet sludge is an organic wet sludge and said method includes adding an organic binder to said organic wet sludge prior to drying said organic wet sludge by surface evaporation.

24. A method of stabilizing wet sludge comprising the steps of:

exposing a first quantity of wet sludge, having a top surface, to surface evaporation to form a dried, top surface;

adding a second quantity of wet sludge to said dried, top surface and mixing said second quantity of wet sludge with said dried, top surface to form a wet sludge mixture having a water content within an operable range which permits said wet sludge mixture to have a self-supporting consistency wherein the mixing process creates irregular surfaces and voids within said wet sludge mixture to significantly increase evaporation surface area while maintaining a sufficiently high surface water content, wherein the combined effect of the increased evaporation surface area and the sufficiently high surface water content is to maximize surface evaporation; and drying said wet sludge mixture by surface evaporation to form a substantially dried sludge mixture.

25. A method of stabilizing wet sludge comprising the steps of:

drying a layer of wet sludge by surface evaporation;

adding additional wet sludge to said previously-dried layer and mixing said additional wet sludge with said previously-dried layer to form a wet sludge mixture having a water content within an operable range which permits said wet sludge mixture to have a self-supporting consistency wherein the mixing process creates irregular surfaces and voids within said wet sludge mixture to significantly increase evaporation surface area while maintaining a sufficiently high surface water content, wherein the combined effect of the increased evaporation surface area and the sufficiently high surface water content is to produce a surface evaporation rate greater than both that of said wet sludge and that of said previously-dried layer; and drying said wet sludge mixture by surface evaporation to form a substantially dried sludge mixture.

26. A method in accordance with claim 25, wherein the surface evaporation rate of said wet sludge mixture is at least 150% of the free water surface evaporation rate of said wet sludge.

* * * * *

UNITED STATES PATENT AND TRADEMARK OFFICE

CERTIFICATE OF CORRECTION

PATENT NO. : 5,355,594

DATED : October 18, 1994

INVENTOR(S) : Daekyoo Hwang

It is certified that error appears in the above-identified patent and that said Letters Patent is hereby corrected as shown below:

Column 11, line 15, delete "1 X $10^6$ cm/sec" and insert --1 X $10^{-6}$ cm/sec--.

Signed and Sealed this

Fourteenth Day of March, 1995

*Attest:*

*Attesting Officer*

BRUCE LEHMAN

*Commissioner of Patents and Trademarks*